US007086212B2

(12) United States Patent
Smithson et al.

(10) Patent No.: US 7,086,212 B2
(45) Date of Patent: Aug. 8, 2006

(54) APPARATUS AND METHOD FOR VACUUM PACKING PRODUCTS

(75) Inventors: Martin Dominic Smithson, Malvern (GB); David Richardson, Chorley (GB); Tien Tjiu Tan, East Java (ID)

(73) Assignee: Transave Limited, Lancashire (GB)

( * ) Notice: Subject to any disclaimer, the term of this patent is extended or adjusted under 35 U.S.C. 154(b) by 186 days.

(21) Appl. No.: 10/124,774

(22) Filed: Apr. 17, 2002

(65) Prior Publication Data

US 2002/0157353 A1 Oct. 31, 2002

(30) Foreign Application Priority Data

Apr. 17, 2001 (GB) ..... 0109445.7

(51) Int. Cl.
*B65B 1/24* (2006.01)

(52) U.S. Cl. ..... 53/527; 53/512; 53/101

(58) Field of Classification Search ..... 53/101, 53/512, 511, 526, 527, 563, 550, 434, 373.6
See application file for complete search history.

(56) References Cited

U.S. PATENT DOCUMENTS

| | | | | |
|---|---|---|---|---|
| 2,481,611 A * | 9/1949 | Moore | ..... | 53/525 |
| 2,559,368 A | 7/1951 | Pancratz | | |
| 4,221,101 A | 9/1980 | Woods | ..... | 53/79 |
| 4,418,514 A * | 12/1983 | Spann | ..... | 53/436 |
| 4,736,572 A | 4/1988 | Fang et al. | ..... | 53/512 |
| 4,765,125 A * | 8/1988 | Fafournoux | ..... | 53/512 |
| 5,664,408 A * | 9/1997 | Chesterfield et al. | ..... | 53/512 |
| 6,321,512 B1 * | 11/2001 | O'Connor et al. | ..... | 53/429 |
| 6,637,177 B1 * | 10/2003 | Trillich et al. | ..... | 53/434 |

FOREIGN PATENT DOCUMENTS

| | | | | |
|---|---|---|---|---|
| EP | 0 003 176 | | 11/1979 | |
| EP | 0 549 487 A1 | | 12/1992 | |
| EP | 0 734 951 A2 | | 2/1996 | |
| FR | 1195752 | | 11/1959 | |
| GB | 728239 | | 9/1952 | ..... 94/1 |
| GB | 2074972 | | 5/1989 | |
| GB | 1262279 | * | 4/2003 | ..... 53/526 |
| JP | 4-114833 | | 4/1992 | |
| JP | 04 201815 | | 7/1992 | |
| JP | 2000-335516 | | 12/2000 | |

* cited by examiner

*Primary Examiner*—John Paradiso
(74) *Attorney, Agent, or Firm*—Welsh & Katz, Ltd.

(57) ABSTRACT

An apparatus for vacuum packing a product (1) in a flexible enclosure (2) therefor, the apparatus comprising means (6, 7) for evacuating air from within the unsealed enclosure (2), the product (1) being disposed within the unsealed enclosure (2), means (18, 19) for restraining sealable meeting portions (3*a*, 3*b*) of the unsealed enclosure (2), during the said evacuation of air, in a configuration whereby the said sealable meeting portions (3*a*, 3*b*) can be sealed without substantial rucking thereof and means (33, 34) for sealing the sealable meeting portions (3*a*, 3*b*) of the unsealed enclosure (2) in an airtight manner in the said configuration thereof, after the said evacuation of air.

35 Claims, 9 Drawing Sheets

APPARATUS AND METHOD FOR VACUUM PACKING PRODUCTS

The present invention relates to an apparatus and a method for vacuum packing products in flexible airtight enclosures, and more particularly to an apparatus and a method for vacuum packing a plurality of unconstrained products.

It is known to vacuum pack products in flexible airtight, particularly thermoplastic, enclosures. Generally speaking, the product to be packed is placed within the unsealed enclosure and the assembly placed in a vacuum treatment zone within a vacuum packing apparatus. The treatment zone is isolated from the surrounding atmosphere, for example by closing a hood over the assembly of the unsealed enclosure and the product; air is then evacuated from the treatment zone and from the assembly; and a sealing means within the treatment zone is then actuated remotely to seal meeting parts of the enclosure together while maintaining the vacuum, whereby the enclosure is sealed around the product in an airtight manner. After sealing of the enclosure, the vacuum is broken, the treatment zone opened and the vacuum packed product removed from the apparatus. The result is a vacuum packed product sealed within the flexible airtight enclosure, the enclosure being collapsed tightly around the product as a result of atmospheric pressure acting on the outside of the enclosure.

The known apparatus and method suffer from a number of disadvantages. The evacuation of a vacuum treatment zone is wasteful of energy, and the apparatus must therefore be manufactured in a range of sizes, to cater for different sizes of product to be packed. A vacuum packing facility can only handle product up to the maximum size suitable for the available apparatus.

Moreover, it is found that the evacuation of air from the flexible enclosure can be incomplete, as the walls of the enclosure can collapse on themselves before the vacuum is established, hindering complete evacuation of the enclosure. If the product to be packed contains air, this may be initially trapped in the product and may gradually seep from the product into the sealed enclosure after the packing is completed, further reducing the quality of the vacuum in the enclosure. The meeting portions of the enclosure may also ruck, so that when the seal is applied to them it is of poor quality or even not airtight. Because the vacuum treatment zone of the vacuum packing apparatus is isolated from the surroundings of the apparatus during evacuation, and is typically not visible from outside the treatment zone, it is not possible to rectify problems of this sort during the procedure.

Still further, difficulties can be encountered when vacuum packing a plurality of unconstrained products (such as a stack of plastic bags), which should be maintained in a defined configuration with respect to each other within the flexible enclosure for the vacuum packing. The outflow of air from the unsealed enclosure during evacuation of the treatment zone can cause the unconstrained products to move with respect to each other, which may be undesirable.

The present invention aims to go at least some way towards overcoming the above disadvantages, or at least to provide an alternative apparatus and method for vacuum packing products.

In accordance with a first aspect of the present invention, there is provided an apparatus for vacuum packing a product in a flexible enclosure therefor, the apparatus comprising:

means for evacuating air from within the unsealed enclosure, the product being disposed within the unsealed enclosure;

means for restraining sealable meeting portions of the unsealed enclosure, during the said evacuation of air, in a configuration whereby the said sealable meeting portions can be sealed without substantial rucking thereof; and means for sealing the sealable meeting portions of the unsealed enclosure in an airtight manner in the said configuration thereof, after the said evacuation of air.

It is preferred that the means for evacuating air from within the unsealed enclosure is adapted to evacuate only air from within the unsealed enclosure, without removal of air surrounding the enclosure.

The apparatus therefore preferably does not include a closable treatment zone into which an assembly of the product disposed in the unsealed enclosure is placed, and from which, after closure of the treatment zone, air can be extracted both from within and around the enclosure.

Whilst it is preferred that the apparatus does not include a closable treatment zone it will be obvious to a skilled person that this does not preclude the use of the apparatus according to the present invention with such a treatment zone. For example, a conventional vacuum packing apparatus as described above could be modified to work according to the present invention.

As described, conventional apparatus suffers from a number of disadvantages. These include incomplete evacuation of air and undesirable rucking of the meeting portions. Such disadvantages could be reduced or eliminated by the use of the apparatus according to the present invention inside a closable treatment zone.

Air Evacuation Means

The means for evacuating air from within the unsealed enclosure preferably comprises an air extraction passageway having a first end adapted to be disposed between the sealable meeting portions of the flexible enclosure and connectable to a suction source for extraction of air from the interior of the flexible enclosure. The suction source may be any suitable suction device or apparatus, for example a conventional vacuum pump.

If desired, more than one generally like air evacuation means may be used simultaneously, to optimise the speed and extent of air extraction from the enclosure.

The or each extraction passageway may, for example, comprise a tube having a first end adapted to be disposed between the sealable meeting portions of the flexible enclosure and a second end connected in air flow communication to the vacuum source.

The or each air extraction passageway may have multiple apertures at the first end thereof, to optimise the speed and extent of air extraction from the enclosure. The multiple apertures may suitably be connected to the air extraction passageway via multiple branches of the passageway, which may spread out from a single passageway in the direction from the second to the first ends thereof. Such an air passageway may, for example, comprise a rigid hollow member internally configured to define the air passageway, the multiple branches thereof and the multiple apertures at the first end thereof.

The air extraction passageway is preferably dimensioned and arranged to be inserted between the sealable meeting portions of the flexible enclosure without interfering with the operation of the restraining means for the sealable meeting portions of the unsealed enclosure.

Restraining Means for the Sealable Meeting Portions of the Unsealed Enclosure

The means for restraining the sealable meeting portions of the unsealed enclosure for the evacuation of air therefrom preferably comprises members adapted to engage the unsealed enclosure at two or more locations of the meeting portions thereof, and to apply a tension to the meeting portions between the said two or more locations thereof so that the said portions are drawn into substantially parallel alignment with respect to each other, substantially free from undesired rucks, in which condition the meeting portions may subsequently be sealed together.

Where the sealable meeting portions of the enclosure comprise the rim of a mouth of the enclosure, the members may suitably comprise finger-like structures, most suitably a pair of such structures, which may be inserted at a first mutual separation distance into the mouth of the enclosure and thereafter moved mutually apart to a second, larger, separation distance corresponding to the maximum separation distance permitted by the dimensions of the mouth of the enclosure, whereby a tension is imparted to the mouth of the enclosure, sufficient to substantially remove undesired rucks without substantially damaging the enclosure.

Enclosure Sealing Means

The means for sealing the sealable meeting portions of the unsealed enclosure in an airtight manner after evacuation of the air preferably comprises a conventional heat sealing device, for example an elongate heatable member which bears against an opposed second member, optionally also heatable, with the sealable meeting portions of the unsealed enclosure interposed between the two members. The heating is preferably performed electrically. By applying sufficient heat, and optionally pressure, to the aligned meeting portions of a plastic enclosure, for example, the sealing means melts the meeting portions together to create an airtight seal. Most preferably the heat sealing takes place in two or more lines. For this purpose, the apparatus is preferably provided with correspondingly shaped electrical heating members mounted on opposed supports which overlie opposite sides of the enclosure at the region of intended sealing. The supports are moveable towards and away from each other, so that the heating members can be brought into and out of contact with the enclosure for the sealing. It is particularly preferred that a further heated member is provided associated with the support members, to serve as a hot cutter to trim away any residual web of enclosure material beyond the seal.

The electrical heating of the heating members may preferably be provided only when the heating members are in contact with the material of the enclosure (so-called impulse sealing). Preferably all the heating members are actuated simultaneously.

The degree of applied heat, and optionally pressure, and the period of time over which the sealing means should be actuated, will depend on the nature and thickness of the meeting portions of the plastic enclosure, and may readily be chosen by one of ordinary skill in this art.

Configuration and Orientation of the Apparatus

The parts of the apparatus according to the first aspect of the present invention are preferably mounted to a body part such as, for example, a frame. The apparatus may be used in any desired orientation. This feature represents a further advantage of the apparatus of the present invention. The assembly of the product to be vacuum packed and the unsealed flexible enclosure may rest on a floor or like surface beside the apparatus, the sealable meeting portions of the flexible enclosure being received in the apparatus for the vacuum packing. Alternatively, the apparatus may be adapted to rest on a floor or like surface, and may include an upwardly directed, preferably planar, surface for supporting the product disposed within the unsealed enclosure in a convenient position relative to the operative parts of the apparatus. The support surface of the apparatus, when present, preferably comprises a rigid planar sheet supported adjacent the operative parts of the apparatus, of dimensions larger than the assembly of the product and the unsealed enclosure. Where the product is a stack of plastic shopping bags, for example, the support surface may have dimensions of at least about 50 cm by about 50 cm.

Where the product to be vacuum packed is a plurality of unconstrained products that should be maintained in a desired configuration with respect to each other, such as a stack of plastic shopping bags which should be maintained in registration, the apparatus preferably further comprises means for constraining the plurality of products in the said desired configuration within the enclosure during the evacuation of the air.

According to a second aspect of the present invention, therefore, there is provided an apparatus for vacuum packing a plurality of products in a desired packing configuration in a flexible enclosure therefor, the products being liable to movement with respect to one another during vacuum packing, the apparatus comprising:

means for evacuating air from within the unsealed enclosure, the products being disposed within the unsealed enclosure in the desired packing configuration;

means, disposed externally of the unsealed enclosure containing the products disposed therein, for constraining the products in the said desired packing configuration within the enclosure for the said extraction of air; and means for sealing sealable meeting portions of the unsealed enclosure in an airtight manner after the said evacuation of air.

Means for Constraining a Plurality of Products in a Desired Packing Configuration The means for constraining the plurality of products in the desired packing configuration is preferably disposed externally of the flexible enclosure.

Most preferably, the means for constraining the plurality of products in the desired packing configuration comprises a pressure member disposed externally of the flexible enclosure, which pressure member bears, preferably in a continuous manner during the vacuum packing method, against a portion of the enclosure to clamp the products, disposed within the enclosure, against an opposed surface such as a floor surface or the support surface of the apparatus. The pressure member may suitably comprise a pneumatically actuable pressure plate.

The means for constraining the plurality of products in the desired packing configuration may comprise a physical barrier disposed externally of the flexible enclosure and adapted to constrain undesired movement of the contents of the enclosure during the air extraction.

The direction and extent of application of constraining pressure on the flexible enclosure and its contents is preferably selected to optimise the resultant constraint of movement of the contents of the enclosure during the evacuation of air. In the case of a compressible product, or in the case where the enclosure and/or the product contains trapped air, the direction and extent of application of the constraining pressure may also preferably be selected to optimise the pushing out of air trapped in the enclosure and/or the product, prior to the evacuation of air from the enclosure.

For example, when the products to be packed are a plurality of plastic shopping bags in a registered stack, the pressure member is suitably arranged to bear against the enclosure and the stack therein in a direction onto a major face of the stack. In this way, air trapped within each bag can be pushed out by the applied pressure, the frictional resistance to shear-like slipping of the stack from the condition of registration is substantially increased, and the volume of the stack can be reduced by up to about 50%. For further constraint against such slipping, a peripheral restraining barrier may be disposed to closely surround the sides of the stack or some of them during the application of the pressure.

The application of pressure on the flexible enclosure and its contents to expel air therefrom provides the further advantage of faster subsequent evacuation of air from the enclosure.

Means for Compressing the Enclosure and the Product Therein

The provision of means for pushing out air trapped in the enclosure and/or the product, prior to evacuation of air from the enclosure, is new and constitutes a further aspect of the present invention. The resultant substantial reduction in packed volume of the product is highly beneficial, in terms of containerised transportation costs.

According to a third aspect of the present invention, there is provided an apparatus for vacuum packing a compressible product in a flexible enclosure therefor, the apparatus comprising:

means for evacuating air from within the unsealed enclosure, the product being disposed within the unsealed enclosure;

means, disposed externally of the unsealed enclosure containing the product disposed therein, for compressing the product within the enclosure prior to evacuation of the air from within the enclosure, whereby air trapped in the enclosure and the product is pushed out of the enclosure and/or the product prior to evacuation of air from the enclosure; and means for sealing sealable meeting portions of the unsealed enclosure in an airtight manner after the said evacuation of air.

The means for compressing the product in the enclosure preferably comprises the same parts as the means for constraining a plurality of products in the desired packing configuration. The parts of the apparatus according to the second and third aspects of the present invention are preferably as described above in connection with the first aspect of the present invention.

Means for Compressing the Product Prior to it being Disposed within the Flexible Enclosure To improve the efficiency of the product loading and also reduce the cost of materials, the apparatus according to the various aspects of the present invention preferably further comprises means for compressing the product prior to insertion into the flexible enclosure. This results in a reduction of the size of enclosure required for a given product, which reduces material costs and also improves the loading of the product into the enclosure as described below. The subsequent reduction in packed volume is also beneficial in terms of containerised transportation costs.

The means for compressing the product prior to it being disposed within the enclosure preferably comprises a first pressure member, separate from the means for constraining/compressing the product during extraction of air, arranged to bear against a portion of the product and compress it against a corresponding member disposed below said product. The first pressure member may suitably comprise a pneumatically actuable pressure plate.

The compression of the product enables it to be disposed within a smaller enclosure than would normally be possible. To ensure the product remains in the compressed state whilst being disposed within the enclosure the first pressure member preferably remains in place whilst the product is disposed within the enclosure. The first pressure member can then be removed when the constraining/compressing means acts on the product and holds it in place. In order for this operation to be performed effectively it is preferred that the pressure plate of the first pressure member has a cut away portion equal to the size of the pressure plate of the constraining/compressing means. This will ensure that both pressure plates can exert a force on the surface of the product at the same time thus enabling the first pressure member to be removed from the enclosure by increasing the force exerted by the constraining/compressing pressure plate.

Means for Clamping the Meeting Portions of the Enclosure

To permit the enclosure to be evacuated, the apparatus according to the various aspects of the present invention preferably further comprises a first clamping means adapted and located to clamp together in substantially airtight manner meeting portions of the unsealed enclosure in a region thereof located between the intended place of sealing of the meeting portions of the enclosure and the periphery of the enclosure, and optionally a second clamping means, spaced apart from the first clamping means and adapted and located to clamp together in substantially airtight manner meeting portions of the unsealed enclosure located between the product contained therein and the intended place of sealing of the meeting portions of the enclosure.

The first and second clamping means preferably each comprise a pair of opposed clamp members disposed on opposite sides of the meeting portions of the enclosure and the clamp members of each pair being adapted to be relatively movable—preferably under pneumatic power—towards and away from each other for respectively clamping and releasing the sealable meeting portions of the enclosure. The or each clamping means is adapted to permit the air evacuation means and the enclosure meeting portions restraining means to function unhindered during operation of the clamping means. For example, at least one of the clamp members of each opposed pair is preferably provided with a resilient, e.g. natural or synthetic rubber, portion, the resilient portion being conformable in substantially airtight manner to the shape of apparatus parts interposed between the pair of clamp members, including, for example, the air extraction passageway(s) and the restraining means for the sealable meeting portions of the unsealed enclosure.

These clamping means are preferably capable of fine control of the closing force thereon—preferably via pneumatic control means—to permit the alignment of the meeting portions of the enclosure to be finely adjusted before sealing, and any rucks therein removed before sealing, while the extraction of air is taking place.

The apparatus according to the present invention permits a wide range of product types and sizes to be efficiently vacuum packed. However, the apparatus preferably comprises a further modification for the vacuum packing of large items, especially those of a relatively low density. To improve the neatness of the seal when vacuum packing large or low density items, the apparatus according to the second and third aspects of the present invention preferably further comprises a support surface moveable with respect to the compression/constraining means the position of which can be controlled to keep the centre of the product in line with the sealing means. This helps to provide a neater seal by minimising the amount of excess plastic enclosure. The support surface preferably comprises a pneumatically actuable pressure plate.

Pressure plates may also preferably be arranged to bear against the periphery of the product from the sides and the rear. These pressure plates may suitably comprise pneumatically actuable pressure plates. The side and rear pressure plates preferably exert a low pressure force designed to maintain the product in the optimum position rather than to compress the product. The side and rear pressure plates ensure a more uniformly packaged product, especially when said product is of a low density and consequently the compression plates substantially reduce the product size.

A further adaptation of the apparatus according to any of the first, second and third aspects of the present invention involves the automation of the process for disposing the products in a flexible enclosure. The adaptation preferably involves means for forming an enclosure around a product rather than the product being inserted into a preformed enclosure. The apparatus preferably further comprises a conveying means for conveying a product from a first position to a second position in which the evacuation means is disposed, a means for disposing a sheet of flexible plastics material in the path of said conveying means and further sealing means for sealing the plastics material at the periphery of the product.

In the above described embodiment the product is placed on the conveying means in the first position. The conveying means operates to convey the product to the second position. The sheet of flexible plastics material is disposed in the pathway between the first position and the second position such that the plastics material forms around the product. Sealing means is provided to seal the plastics material at the rear of the product. The apparatus is preferably provided with evacuation means and sealing means on each side of the product at the points where the top and bottom portions of the newly formed enclosure meet. The apparatus can operate as before to evacuate the air from the enclosure and seal the remaining meeting portions.

The apparatus may be fully manually controlled, fully automatically controlled, or part manually, part automatically controlled. The pneumatic systems may conveniently be powered from the suction source employed for the evacuation of air from the enclosure.

The Vacuum Packing Method

According to a fourth aspect of the present invention, there is provided a method for vacuum packing a product in a flexible enclosure therefor, the method comprising, in any suitable order:

(a) disposing the product in an unsealed flexible enclosure therefor, and optionally, if desired, constraining a plurality of unconstrained products in a desired packing configuration within the enclosure and/or compressing the product within the enclosure;
(b) restraining sealable meeting portions of the unsealed enclosure whereby the said sealable meeting portions can be sealed without substantial rucking thereof;
(c) inserting air evacuation means between the said sealable meeting portions of the enclosure;
(d) clamping the said sealable meeting portions of the enclosure in the said restrained condition in substantially airtight manner around the air evacuation means, optionally, if desired, with adjustment of the said restrained condition to avoid substantial rucking of the sealable meeting portions of the enclosure; and
(e) evacuating air from within the unsealed enclosure, the product being disposed therein.

The method according to the fourth aspect of the present invention is preferably performed using the apparatus according to any of the first, second and third aspects of the present invention.

According to a fifth aspect of the present invention, there is provided a method for vacuum packing a plurality of products in a desired packing configuration in a flexible enclosure therefor, the products being liable to movement with respect to one another during vacuum packing, the method comprising, in any suitable order:

(a) disposing the plurality of products in the desired packing configuration in an unsealed flexible enclosure therefor;
(b) constraining the products in the desired packing configuration within the enclosure by applying a pressure on the products externally of the enclosure, the pressure serving to substantially prevent undesired movement of the products and optionally, if desired, to compress the products within the enclosure;
(c) inserting air evacuation means between sealable meeting portions of the enclosure;
(d) clamping the said sealable meeting portions of the enclosure in the said restrained condition in substantially airtight manner around the air evacuation means;
(e) evacuating air from within the unsealed enclosure, the products being disposed therein; and
(f) sealing the sealable meeting portions of the unsealed enclosure in an airtight manner after the said evacuation of air.

The method according to the fifth aspect of the present invention preferably further comprises:

(g) restraining the sealable meeting portions of the unsealed enclosure whereby the said sealable meeting portions can be sealed without substantial rucking thereof.

The method according to the fifth aspect of the present invention is preferably performed using the apparatus according to the second and third aspects of the present invention.

The Nature of the Flexible Enclosure

The flexible enclosure used in the present invention is preferably formed of any suitable plastics or predominantly plastics material capable of providing an airtight enclosure which is capable of being readily sealed, e.g. by heat sealing. It is preferred that the enclosure is formed from a plurality of layers of plastics material. The layers may be the same or different as compared with one another. This reduces the risk of the vacuum being destroyed if, for example, one of the layers is ripped or punctured. The material is preferably recyclable. Polyethylene film may preferably be used. In one particularly preferred form, a laminate of polyethylene films of different densities may be used. Preferably, a three layer laminate of a high density polyethylene (HDPE) film sandwiched between two low density polyethylene (LDPE) films may be used. The plastics material may be treated to impart a range of potentially desirable characteristics to it, depending on the intended use. Such characteristics can include low slip, opacity, resistance to ultra-violet light, water resistance, air moisture resistance, biodegradability, pest repellency (including dog and bird repellency), fragrancing and odour neutralising capacity, chromothermicity, good printability, flame retardancy and colour-change after a certain age (to indicate expiry of shelf life of the packed product).

The enclosures may suitably be provided as separate pre-formed pockets, preferably closed along a portion of the periphery to leave an open mouth for access to the interior and sealing. Alternatively, the enclosures may be provided mutually connected in roll or sheet form, the end enclosure being detached from the remainder as part of the vacuum packing method. The enclosures may provided as a single sheet of plastics material which may be formed into a suitable enclosure as previously described. If desired, the method may include the step of forming one or more seal lines in the enclosure before and/or after insertion of the product to be packed, but before the air extraction stage.

The material of the enclosure may be provided with low-slip surface properties, to reduce shear-like slippage between the enclosure and the product contained therein, and between adjacent stacked enclosures, during the packing process and subsequent storage and transportation of the packs. Low slip properties can conveniently be achieved by incorporating a metallocene into a plastics sheet. A three layer laminate sheet comprising a core sheet of HDPE and two opposed outer sheets of metallocene-containing LDPE provides an acceptable low-slip polyethylene enclosure for use in the present invention.

The flexible enclosure may if desired be formed of a shrink-wrappable plastic material, whereby the enclosure can be shrink-wrapped onto the product, e.g. by applying a suitable external heat to the enclosure. Shrink-wrapping may suitably take place after the vacuum packing stage has been completed, and may serve to improve resistance to transport and handling damage, as well as helping to maintain conformity of the pack.

Most plastics, including polyethylene, form films in which there is a preferential direction of tearing, i.e. one direction in which a tear will propagate relatively easily compared with all or most other directions. In one particular preferred aspect of the present invention, the flexible enclosure for use in the present invention will be orientated such that any preferential direction of tearing of the enclosure material to open the sealed enclosure extends from the seal towards the product which is vacuum packed in the sealed enclosure. In this way, by breaking the enclosure material in the region of the seal and starting one or more tear line in a direction towards the packed product, it should be relatively easy to tear the enclosure sufficiently to gain access to the packed product.

We have also found that, if a further film of a material of sufficient thickness, at least a portion of which is substantially non-adhesive to the enclosure material, for example paper, is disposed in the vacuum packed enclosure between the seal and the product, and markings are provided to direct a person to open the vacuum pack by initially puncturing the enclosure in the region of the film, for example in the region of a substantially non-adhesive portion of the film, the initial step of breaking the enclosure material in the region of the seal and starting one or more tear line in a direction towards the packed product is considerably simplified. Without wishing to be bound by theory, it is believed that the presence of the further film of a material at least a portion of which is substantially non-adhesive to the enclosure material maintains the meeting portions of the enclosure sufficiently apart when the seal is broken that the inrush of atmospheric air penetrates between the meeting portions of the enclosure, whereas without the further film the inrush of atmospheric air can act on the meeting portions of the enclosure, or flexible flap portions of the enclosure material at an edge thereof, to push the portions back together.

Thus, the presence of the further film has the effect of substantially speeding breakage of the vacuum when the enclosure is punctured in the region of the further film.

According to a sixth aspect of the present invention, there is provided a method of vacuum packing a product in a flexible enclosure therefore, the method comprising, in any suitable order:

(a) disposing the product in an unsealed flexible enclosure therefor;
(b) disposing within the unsealed flexible enclosure between the product and sealable meeting portions of the enclosure a film of a material at least a portion of which is substantially non-adhesive to the material of the enclosure;
(c) evacuating air from within the unsealed enclosure, the product being disposed therein; and
(d) sealing the sealable meeting portions of the enclosure in an airtight manner after the said evacuation of air; whereby the product and the film of material are retained in the flexible enclosure, which is collapsed onto the product and the film of material.

The film of material, e.g. paper, may conveniently be provided with printed matter, and thereby serve as a label for the pack. In this embodiment, we have found that it is advantageous for the second clamping means, when present in the apparatus, to be arranged to bear onto the film of material within the enclosure, to prevent the film of material wrinkling or otherwise distorting during the air extraction and sealing process.

The method according to the sixth aspect of the present invention may comprise any or all of the features of the methods according to the fourth and fifth aspects of the present invention, and is preferably performed using the apparatus according to any of the first, second and third aspects of the present invention.

The present invention also embraces vacuum packed products prepared by any of the methods according to the fourth, fifth and sixth aspects of the present invention. In one particular preferred embodiment, the vacuum packed product is a stack of plastic bags, for example any convenient number of (e.g. up to about 1000) T-shirt or singlet type shopping bags (e.g. bags as described in U.S. Pat. No. 4,493,419, the disclosure of which is incorporated herein by reference) which are stacked in registration and are designed to be mounted on a dispenser for dispensing individual bags for use, e.g. at a check-out or display of a supermarket or shop.

According to a further aspect of the present invention, there is provided a vacuum packed product comprising a product—e.g. a stack of plastic bags which are stacked in registration and are of the type to be mounted on a dispenser for dispensing individual bags for use—the product being vacuum packed in a flexible polymeric enclosure which is collapsed onto the product, the enclosure containing additionally a further film of a material at least a portion of which is substantially non-adhesive to the material of the enclosure disposed in the vacuum packed enclosure between the seal and the product, wherein markings are provided to direct a person to open the vacuum pack by initially puncturing the enclosure in the region of the film of material. The flexible enclosure may suitably be orientated such that any preferential direction of tearing of the enclosure material to open the sealed enclosure extends from the seal towards the product which is vacuum packed in the sealed enclosure. The markings preferably direct a person to open the vacuum pack by initially puncturing the enclosure in the region of a substantially non-adhesive portion of the film of material, and may include directions to puncture the enclosure one or more times. If the enclosure is punctured more than one time, e.g. twice, multiple parallel tear lines can be formed, to open the pack by effectively peeling back a strip of the enclosure material. In this way, by breaking the enclosure material near the seal, and starting one or more tear line in a direction towards the packed product, it is found to be easy to tear the enclosure sufficiently to gain access to the packed product. The film of material is desirably of sufficient thickness, and substantially non-adhesive to the enclosure material over a sufficient portion of the surface of the film, to enable the vacuum to break rapidly when the enclosure is punctured in the region of the film. This aspect of the present invention is applicable to all vacuum packed products, for example those prepared using the apparatus and method of the foregoing aspects of the present invention.

The apparatus and method of the present invention permit a wide range of product types and sizes to be efficiently vacuum packed, with a single apparatus and without the need for a range of apparatus sizes. The step of the evacuation of air from the enclosure can be viewed and controlled more completely and efficiently than has hitherto been possible with the known equipment. Moreover, the invention provides considerable advantages in terms of reduced pack volume and reduced instances of mis-sealing and seal failure.

For ease of understanding the present invention, and to show how the same may be put into effect, an embodiment will now be described, without limitation and purely by way of example, with reference to the accompanying drawings, wherein:

FIG. 10 shows a further embodiment of a frame of a vacuum packing apparatus in perspective view.

Referring to the drawings, in which like parts are designated alike, there is shown generally in FIGS. 1 to 5 an apparatus for vacuum packing a product in a flexible enclosure therefor, and in FIGS. 6 to 9 a vacuum packing method using the apparatus.

As illustrated, the product to be packed is a stack 1 of up to about 1000 T-shirt or singlet type plastic bags and the flexible enclosure is a rectangular polyethylene pouch 2 having low-slip interior and exterior surfaces, the pouch being sealed around three sides of the rectangle to leave an open mouth defined by opposed sealable meeting portions 3*a*,3*b* of the pouch 2. The pouch 2 is comfortably larger than the stack 1, so that the stack can be placed within the pouch prior to evacuation of air from the pouch and sealing of the mouth of the pouch (FIG. 6(*a*)).

Referring particularly to FIGS. 1 to 5 of the drawings, the vacuum packing apparatus comprises a metal frame 4 adapted to stand on a floor. The frame 4 supports an upwardly directed surface 5, on which the pouch 2 and stack 1 therein are placed, so that the mouth of the pouch can conveniently be received in the apparatus for the vacuum packing method, to be described in detail below.

The operative parts of the apparatus comprise generally air evacuation means, means for restraining the sealable meeting portions of the unsealed pouch, means for clamping the sealable meeting portions of the pouch, means for sealing the sealable meeting portions of the pouch, and means for constraining and compressing the stack within the pouch.

Figure 7A:
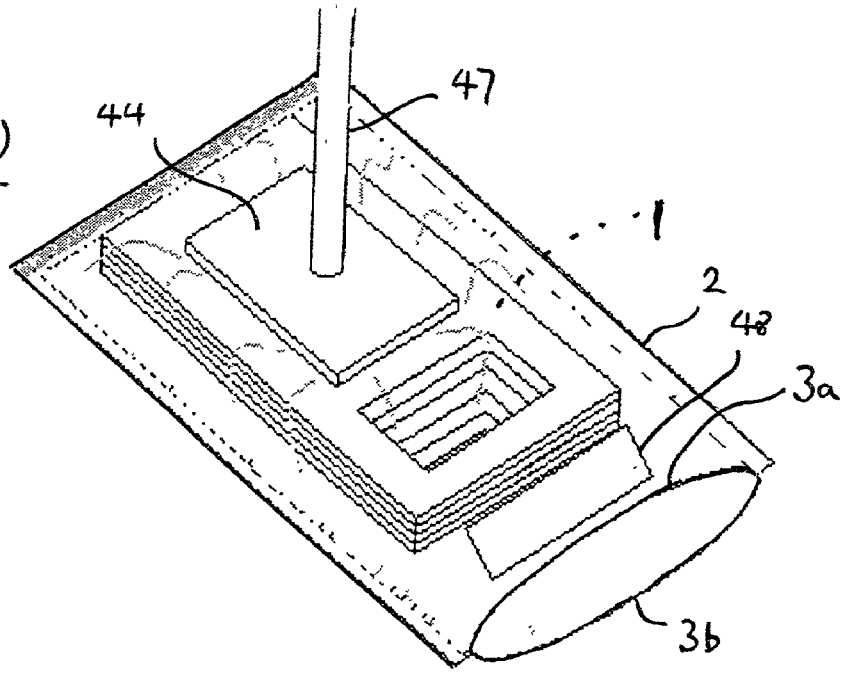
FIG. 7 shows in simplified perspective view the next two stages (a) and (b) of the vacuum packing method begun in FIG. 6.
Figure 7B:
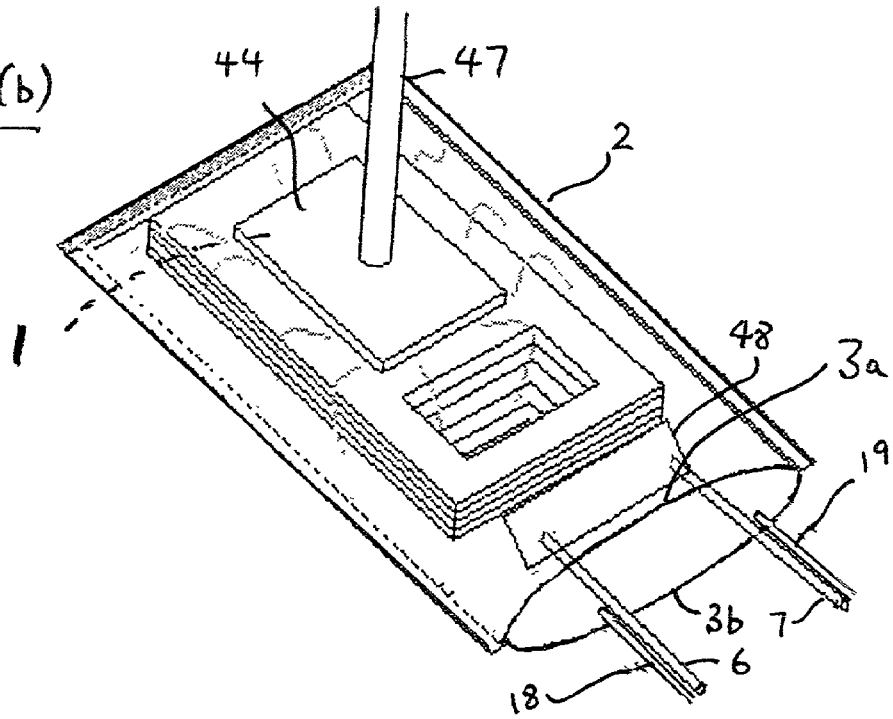
Figure 8B:
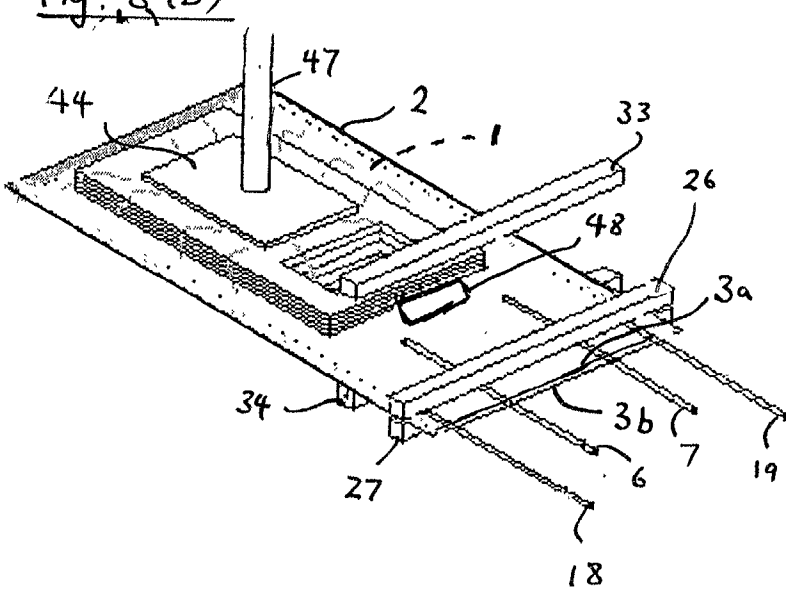
FIG. 8 shows in simplified perspective view the next three stages (a), (b) and (c) of the vacuum packing method begun in FIG. 6 and continued in FIG. 7.
Figure 8A:
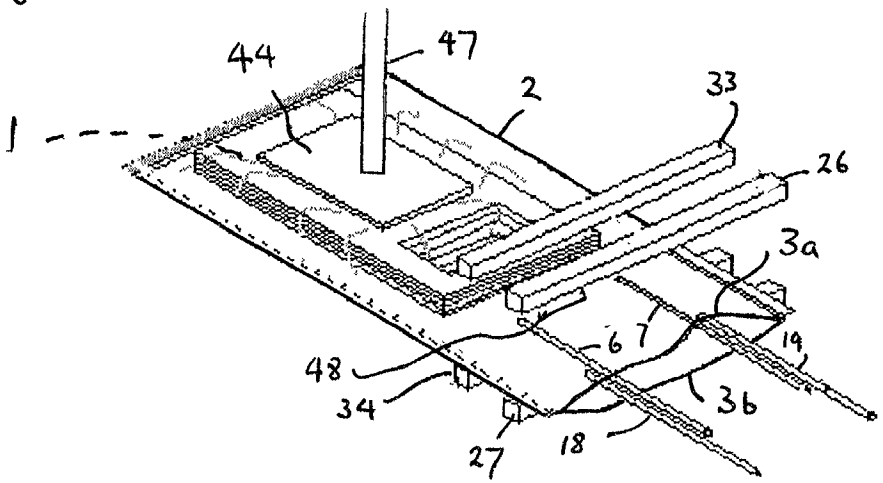
Figure 8C:
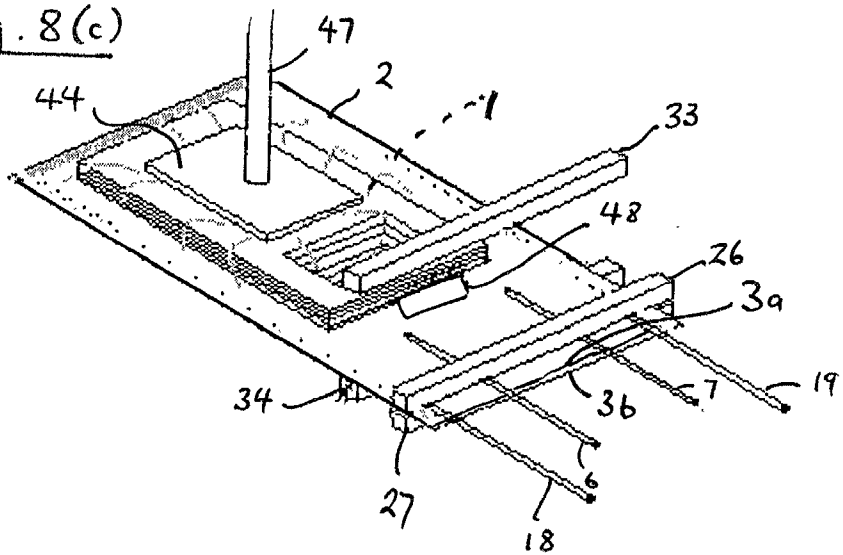

The air evacuation means comprises a pair of air extraction tubes 6,7, each tube having a first end 6*a*,7*a* adapted to be inserted into the mouth of the pouch 2 between the sealable meeting portions 3*a*,3*b* of the pouch (see FIG. 7(*b*) and FIG. 8), and a second end 6*b*,7*b* connected via conventional flexible air lines and actuation valves (not shown) to be in air flow communication with a suction source for extraction of air from the interior of the pouch.

The suction source comprises a conventional vacuum pump 8 powered by an electric motor 9 and connected to a vacuum tank 10 in conventional manner, whereby the vacuum tank 10 is under continuous suction and is maintained below atmospheric pressure by the vacuum pump 8. The vacuum tank 10 thus assists in the rapid establishment of substantially complete vacuum suction on actuation of the suction at the air extraction tubes 6,7 via the conventional valves.

Figure 1:
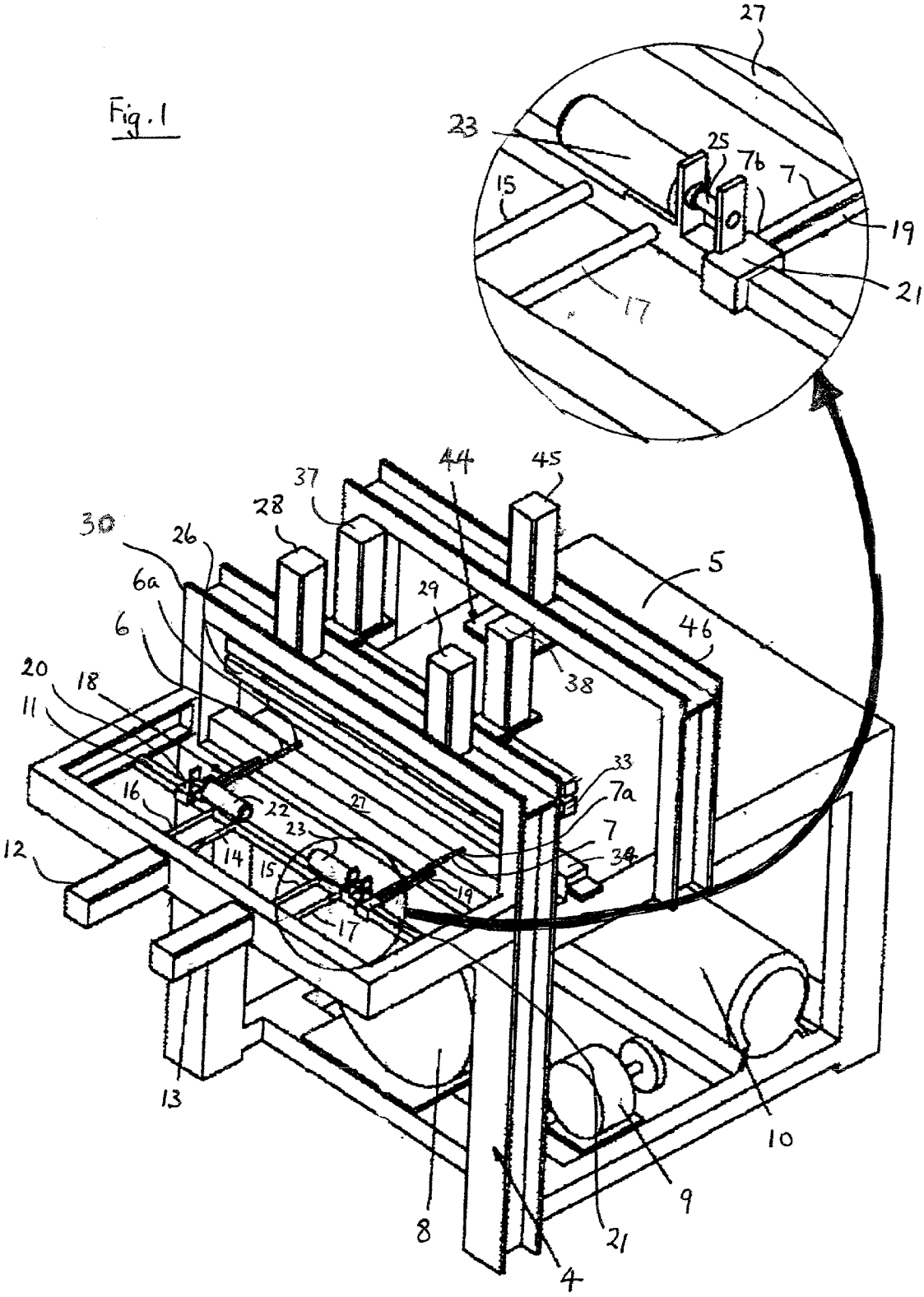
FIG. 1 shows a vacuum packing apparatus in perspective view.
Figure 2:
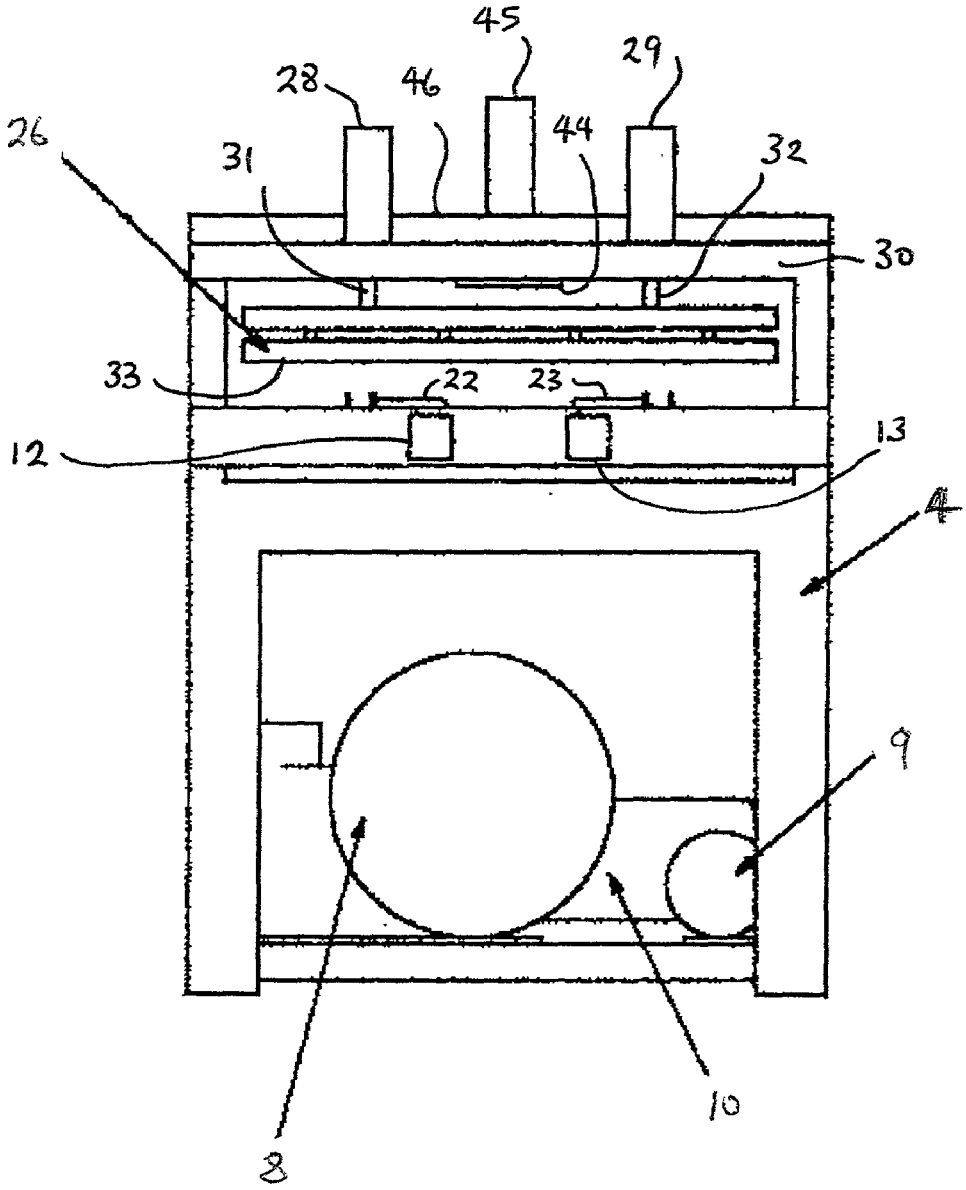
FIG. 2 shows the apparatus of FIG. 1 in front view.
Figure 3:
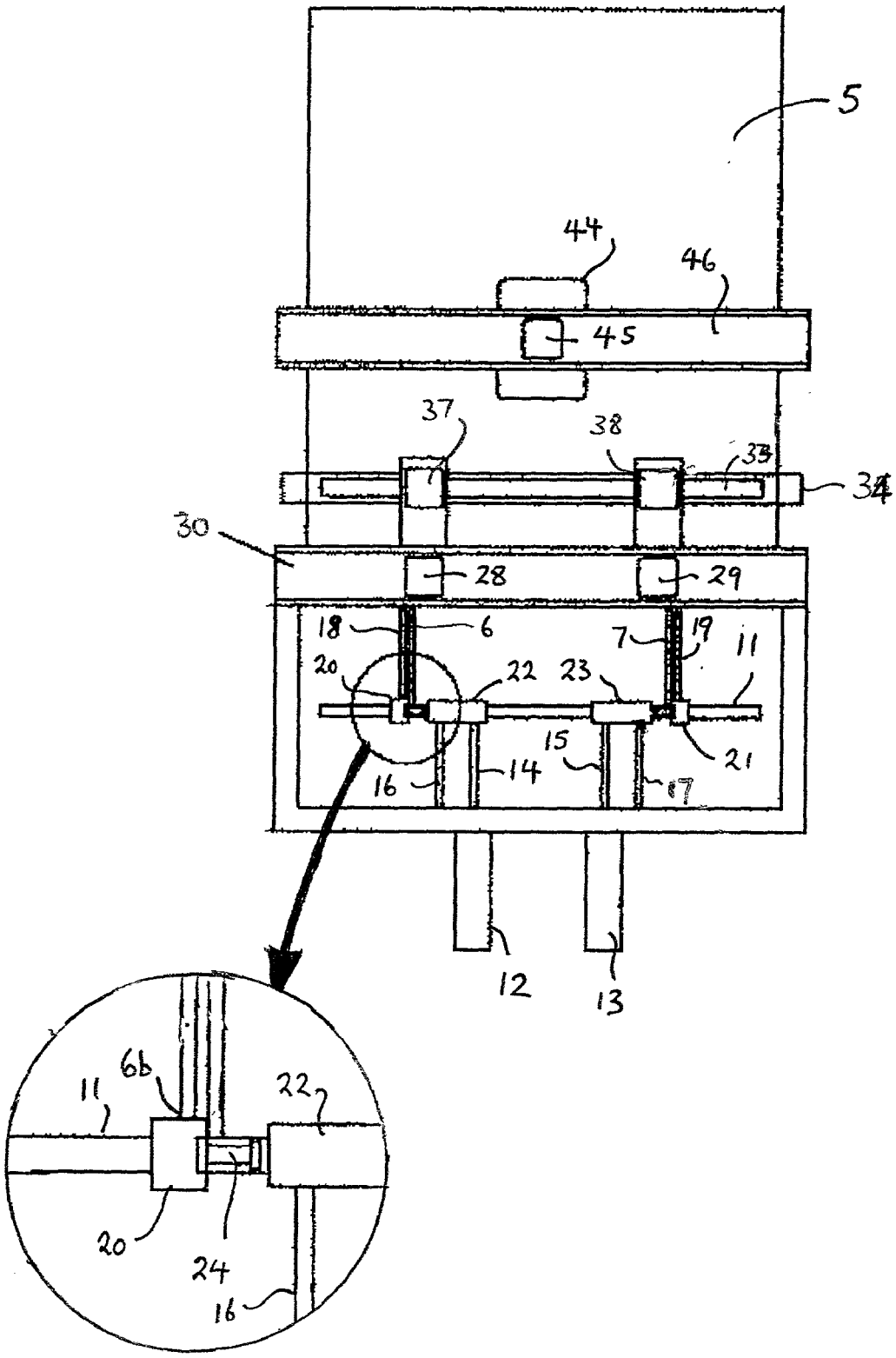
FIG. 3 shows the apparatus of FIG. 1 from above.
Figure 5:
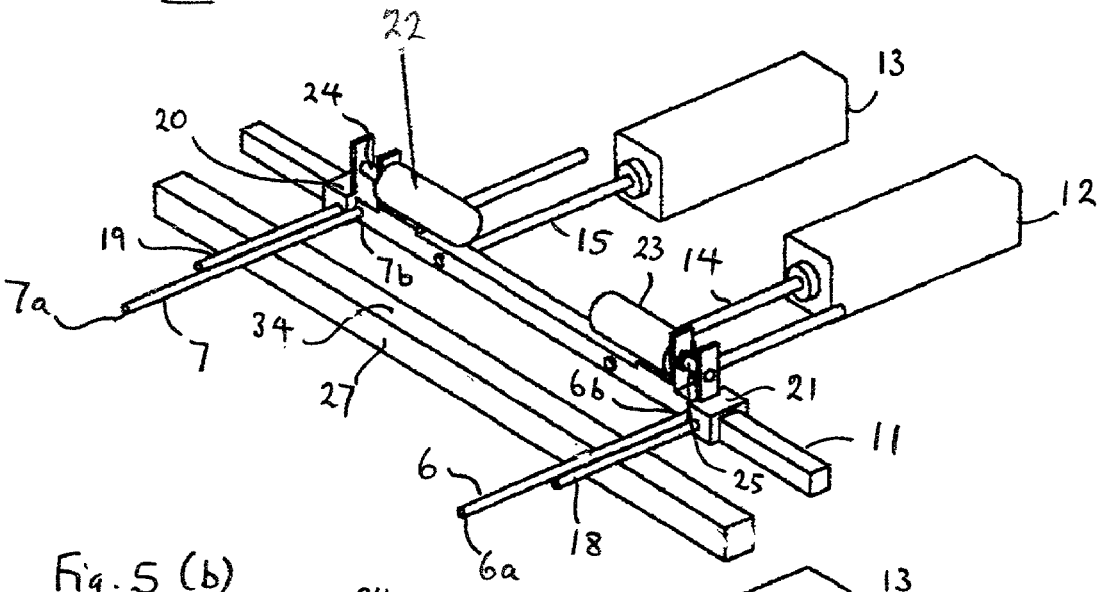
FIG. 5 shows in perspective view a detail of the crossbar part of the apparatus of FIG. 1 and associated air extraction tubes and fingers, and the pneumatic power systems therefor, with the fingers in their (a) relatively close together and (b) relatively far apart conditions.
Figure 5:
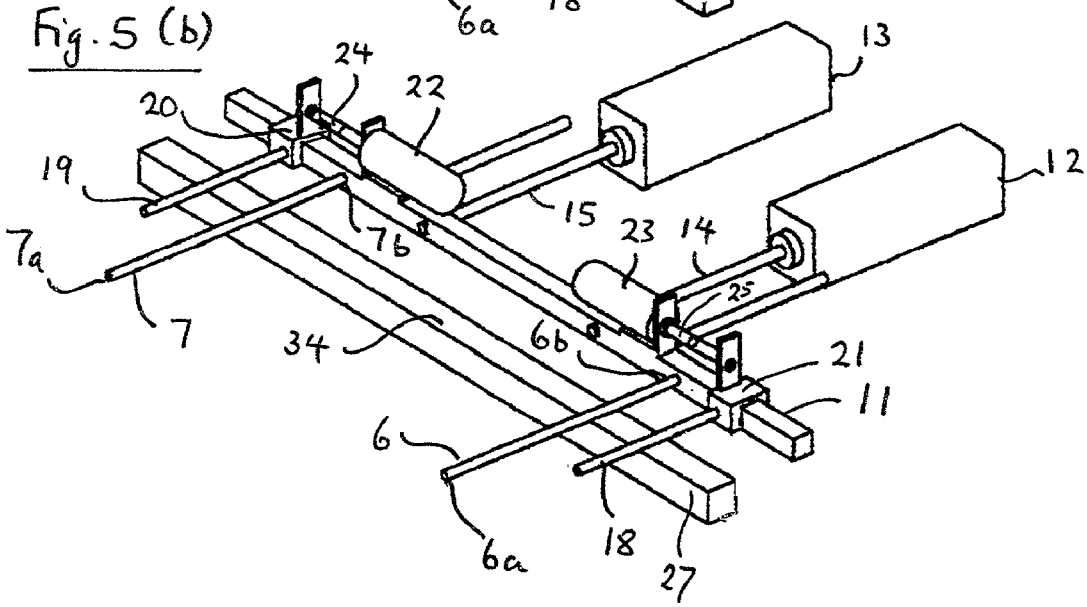

As shown particularly in the detailed enlarged portion of FIG. 1 and in FIG. 5, the air extraction tubes 6,7 are fixedly mounted on a crossbar 11, which is in turn moveable towards and away from the other operative parts of the apparatus, to be described in detail below. This movement of the crossbar 11 is achieved via a pair of pneumatically operable cylinder and piston arrangements 12,13 disposed on the frame 4 and connected to the crossbar 11 via piston rods 14,15. A pair of guide rods 16,17 are also mounted to the crossbar 11 and project parallel with the piston rods 14,15 to be slidingly received in bores provided through the corresponding portion of the frame 4, to support the weight of the crossbar 11.

The means for restraining the sealable meeting portions 3*a*,3*b* of the unsealed pouch 2 comprise a pair of fingers 18,19 which project from the crossbar 11 parallel with, and laterally outside, the air extraction tubes 6,7. The fingers 18,19 are somewhat shorter than the air extraction tubes 6,7, with the result that the fingers do not extend as far into the pouch as the air extraction tubes. The fingers 18,19 are mounted to the crossbar on respective yokes 20,21 slidably disposed on the crossbar 11. The result of this slidable mounting of the fingers 18,19 on the crossbar 11 is that the fingers 18,19 can be inserted into the mouth of the pouch 2 at a first mutual separation distance (preferably the minimum separation distance, as shown in FIG. 5(*a*) and FIG. 8(*a*)) and thereafter moved mutually apart to a second, larger, separation distance corresponding to the maximum separation distance permitted by the dimensions of the mouth of the pouch 2 (see FIG. 5(*b*) and FIGS. 8(*b*) and (*c*)). This outward movement of the fingers 18,19 imparts a tension to the sealable meeting portions 3*a*,3*b* at the mouth of the pouch 2, sufficient to substantially remove undesired rucks thereof, without substantially damaging the pouch 2

(see FIGS. 8(*a*) and 8(*b*)). This movement of the fingers 18,19 is achieved via a pair of pneumatically operable cylinder and piston arrangements 22,23 disposed on a central region of the crossbar 11 and connected to the respective yokes 20,21 via piston rods 24,25.

The means for clamping the sealable meeting portions of the mouth of the pouch comprise a pair of opposed elongate clamp members 26,27 disposed between the crossbar 11 and the surface 5, the pair consisting of an upper clamp member 26 above the plane of the air extraction tubes 6,7 and the fingers 18,19 and a lower clamp member 27 below the said plane. The air extraction tubes 6,7 and the fingers 18,19 can thus pass between the clamp members 26,27 when the said clamp members are apart—i.e. at the start of the vacuum packing method as shown in FIGS. 1 to 5, FIG. 7(*b*) and FIG. 8(*a*).

The lower clamp member 27 is fixedly mounted to the frame 4. The upper clamp member 26 is movable towards and away from the lower clamp member 27, to respectively close and open the clamp action on the sealable meeting portions 3*a*,3*b* of the pouch between the clamp members 26,27. This movement of the upper clamp member 26 is achieved via a pair of pneumatically operable cylinder and piston arrangements 28,29, disposed on a bridge portion 30 of the frame 4 which passes directly above the clamp members 26,27, the said piston and cylinder arrangements 28,29 being connected to the upper clamp member 26 via piston rods 31,32 (see FIG. 2). The upper 26 and lower 27 clamp members are each adapted to permit the air extraction tubes 6,7 and the fingers 18,19 to function substantially unhindered during all stages of operation of the clamp members, i.e. even when the clamp members are closed against each other around the mouth of the pouch 2. For this purpose both of the clamp members 26,27 are made from a resilient material such as rubber, so as to be conformable in substantially airtight manner to the shape of apparatus parts (i.e. particularly, the air extraction tubes 6,7 and the fingers 18,19) interposed between the pair of clamp members 26,27.

Figure 4:
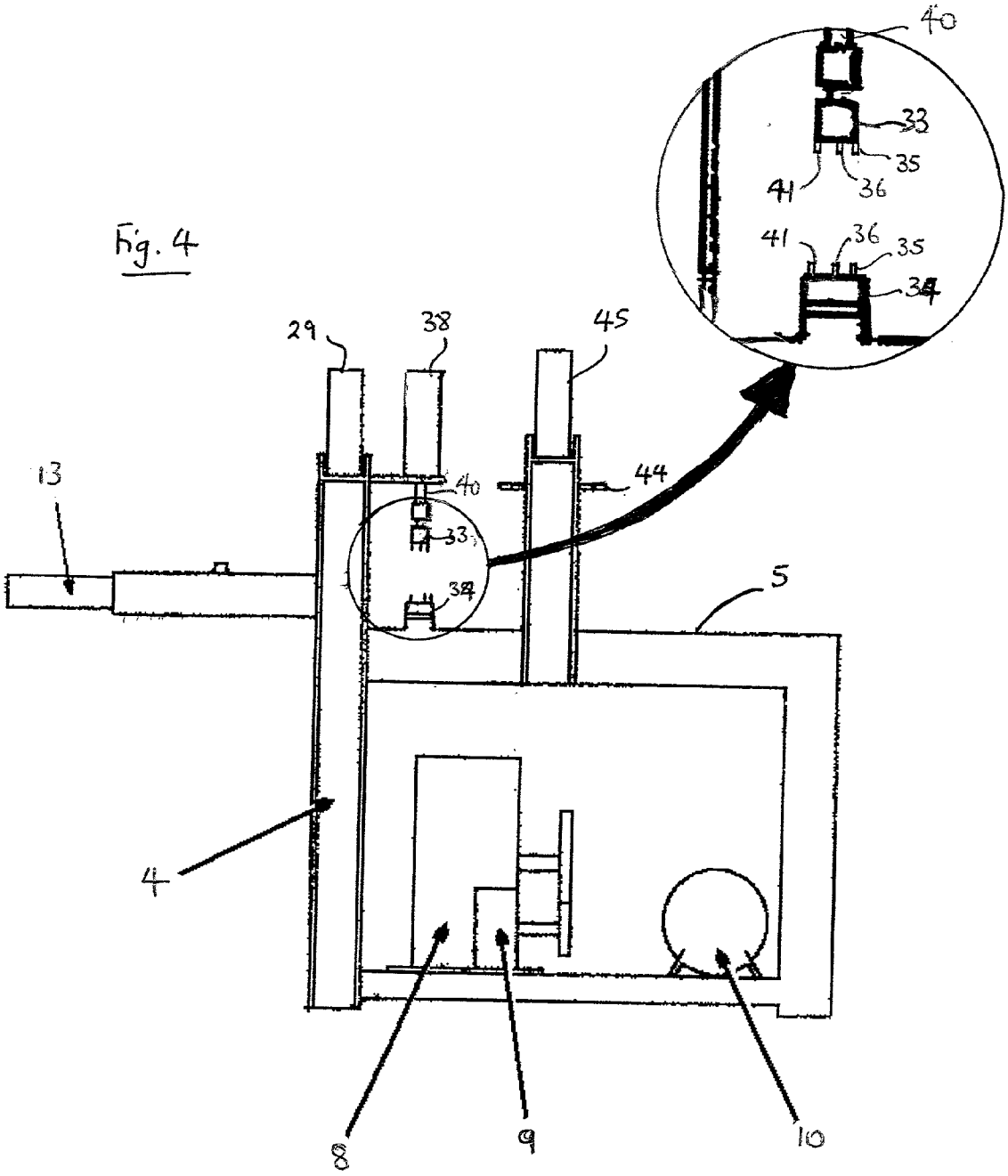
FIG. 4 shows the apparatus of FIG. 1 from the side.

The means for sealing the sealable meeting portions 3*a*,3*b* of the pouch 2 comprise a pair of opposed elongate heat-sealing members 33,34 disposed between the bridge portion 30 of the frame 4 and the surface 5, the pair consisting of an upper heat-sealing member 33 above the plane of the air extraction tubes 6,7 and the fingers 18,19 and a lower heat-sealing member 34 below the said plane. As shown particularly in the enlarged detail in FIG. 4, the heat-sealing members 33,34 are provided with opposed pairs of thin, strip-like, electrical elements 35,36, which overlie opposite sides of the sealable meeting portions 3*a*,3*b* of the pouch 2 at the point of intended sealing. The lower heat-sealing member 34 is fixedly mounted to the frame 4. The upper heat-sealing member 33 is movable towards and away from the lower heat-sealing member 34, to respectively close and open the heat-sealing members with respect to the sealable meeting portions 3*a*,3*b* of the pouch between the heat-sealing members 33,34. This movement of the upper heat-sealing member 33 is achieved via a pair of pneumatically operable cylinder and piston arrangements 37,38, mounted to the bridge portion 30 of the frame 4, the said piston and cylinder arrangements 37,38 being connected to the upper heat-sealing member 33 via piston rods (only the piston rod associated with the piston and cylinder arrangement 38, designated 40 in FIG. 4, is visible in the drawings; the other piston and cylinder arrangement 37, however, has a corresponding piston rod). As also shown in detail in FIG. 4, a further thin electrical heating element 41 is provided on each of the upper and lower heat-sealing members 33,34, to serve as a hot cutter to trim away any residual web of pouch material beyond the seal.

The means for constraining and compressing the stack 1 within the pouch 2 comprise a pressure plate 44 mounted above, and in a plane parallel to the plane of, the surface 5. The pressure plate 44 is arranged to be pressed down onto the pouch 2 supported on the surface 5, to compress the pouch 2 and the stack 1 therein during the vacuum packing method. This movement of the pressure plate 44 is achieved via a pneumatically operable cylinder and piston arrangement 45, disposed on a second bridge portion 46 of the frame 4 which passes above the surface 5, the said piston and cylinder arrangement 45 being connected to the pressure plate 44 via a piston rod 47 (see in particular FIG. 8).

The pneumatic systems of the apparatus are powered from the suction source employed for the evacuation of air from the pouch. However, for clarity the conventional air lines and control valves employed for this purpose have been omitted from the drawings, as they will be already well understood by a reader of ordinary skill in this art.

A vacuum packing method using the apparatus described above will now be described with particular reference to FIGS. 6 to 9.

Figure 6:
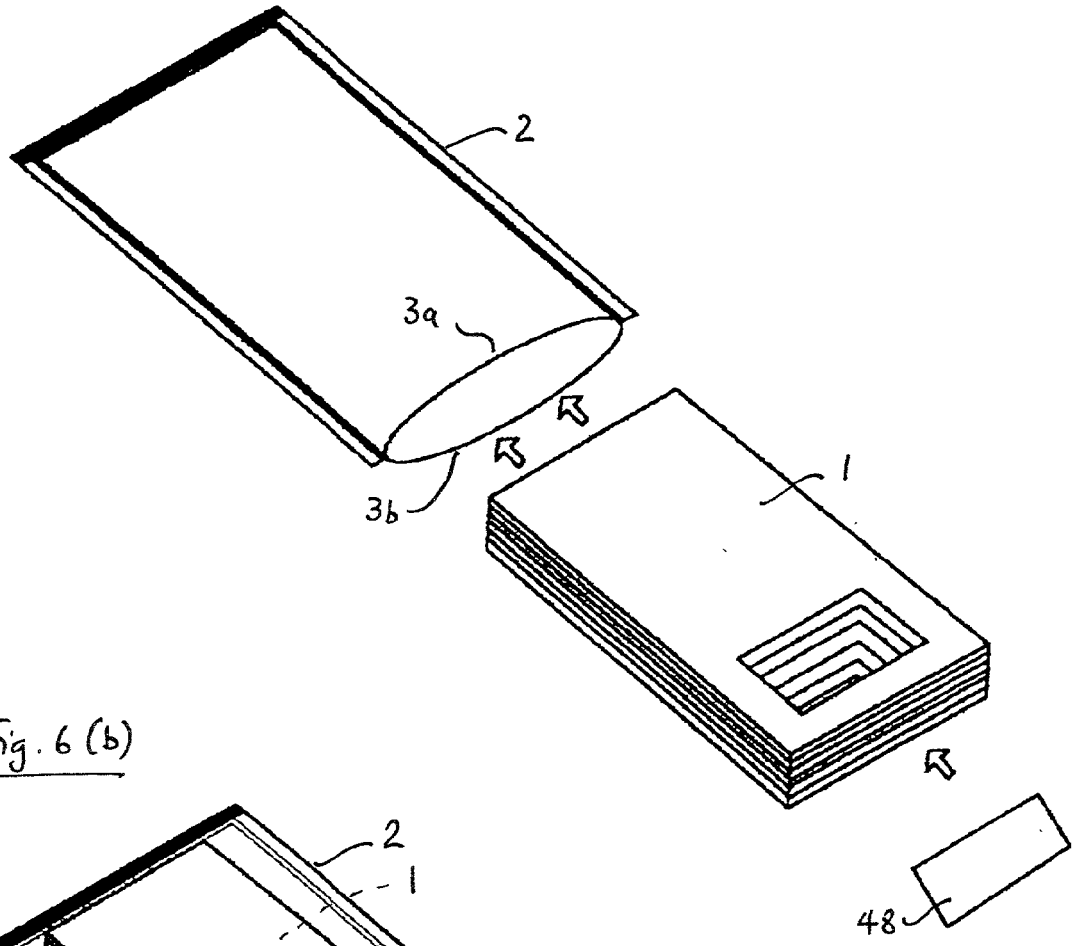
FIG. 6 shows in simplified perspective view the first two stages (a) and (b) of a vacuum packing method.
Figure 6:
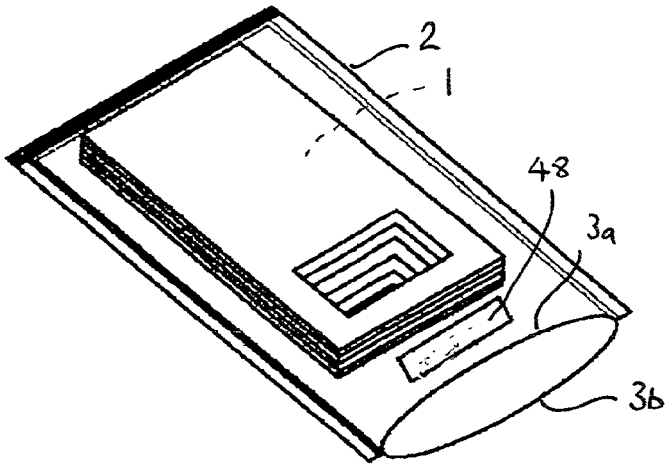

The stack 1 is firstly placed in the pouch 2 (FIG. 6(*a*)). A paper label 48 is then inserted, to lie adjacent the stack just inside the mouth of the pouch (FIG. 6(*b*)). These actions are indicated by the single and double arrows in FIG. 6(*a*).

The pouch 2 and stack 1 therein are then placed on the surface 5 of the apparatus, and the sealable meeting portions 3*a*,3*b* of the mouth of the pouch 2 are drawn into the apparatus between the open upper 26 and lower 27 clamp members. A preliminary pressing stage of bringing the pressure plate 44 down onto the pouch 2 to lightly constrain or compress the pouch and stack therein (FIG. 7(*a*)) may take place now, or may be omitted. The air extraction tubes 6,7 and fingers 18,19 (in their relatively close first mutual separation) are then partially inserted into the mouth of the pouch, via controlled forward movement of the crossbar 11 towards the operative parts of the apparatus, and the paper label 48 is adjusted if necessary. The pressure plate 44 is then brought (fully) down onto the pouch 2 and the stack 1 therein to fully constrain and compress the stack 1, and to expel air from within the pouch 2 and the stack 1 (FIG. 7(*b*)).

The crossbar 11 is then moved fully forward towards the operative parts of the apparatus, under control of the pneumatic operating system, so that the air extraction tubes 6,7 and the fingers 18,19 are each inserted the correct distance into the mouth of the pouch. The air extraction tubes at this stage should extend into the pouch beyond the line of intended sealing of the pouch 2, whereas the fingers 18,19 should extend into the pouch beyond the clamp members 26,27 of the apparatus but not as far as the line of intended sealing (FIG. 8(*a*)). The fingers 18,19 are then spread outwards, to impart the tension to the mouth of the pouch, to substantially remove undesired rucks in the sealable meeting portions 3*a*,3*b* of the mouth of the pouch, and the clamp members 26,27 are then closed together to clamp the mouth of the bag—substantially free of undesired rucks—with the air extraction tubes 6,7 and the fingers 18,19 accommodated between the clamp members 26,27 by virtue of the conformable surfaces of the clamp members, as described above (see FIG. 8(*b*)).

If desired (not shown), at about this time a secondary pneumatically actuated clamp member, disposed to overlie the paper label 48, may be brought down to bear against the pouch 2 in the region of the paper label 48, in order to better maintain the label in flat and uncreased form within the pouch during the subsequent air extraction stage. The construction and operation of the secondary clamp member, which is not illustrated in FIGS. 1 to 5, corresponds to the construction and operation of the upper clamp member 26.

FIG. 8(*c*) shows the air extraction stage, in which the interior of the pouch is evacuated by applying suction to the air extraction tubes 6,7. The compression and constraining of the stack 1 within the pouch 2, by means of the pressure plate 44, is maintained through the stages illustrated in FIG. 8.

Figure 9:
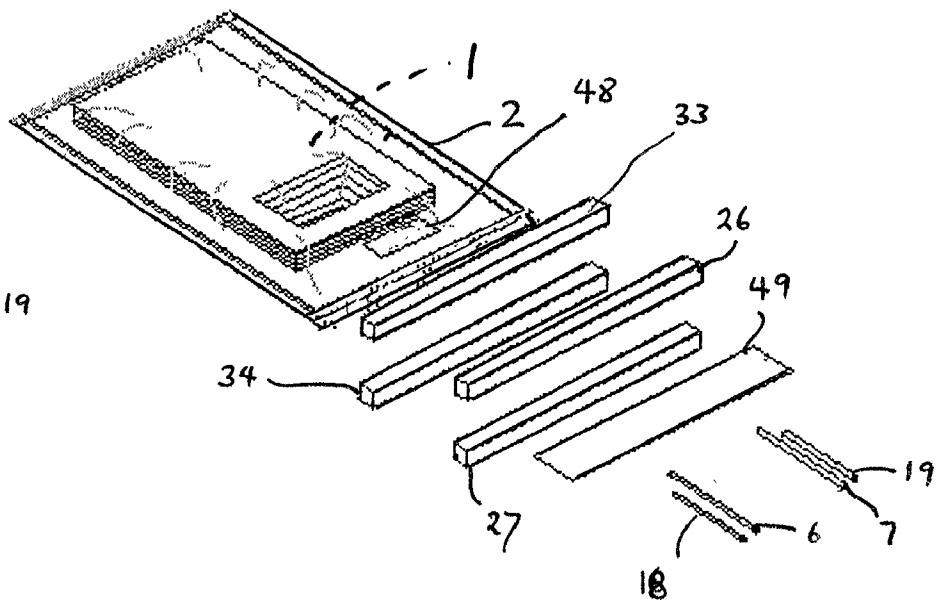
FIG. 9 shows in simplified perspective view the final three stages (a), (b) and (c) of the vacuum packing method begun in FIG. 6 and continued in FIGS. 7 and 8.
Figure 9A:
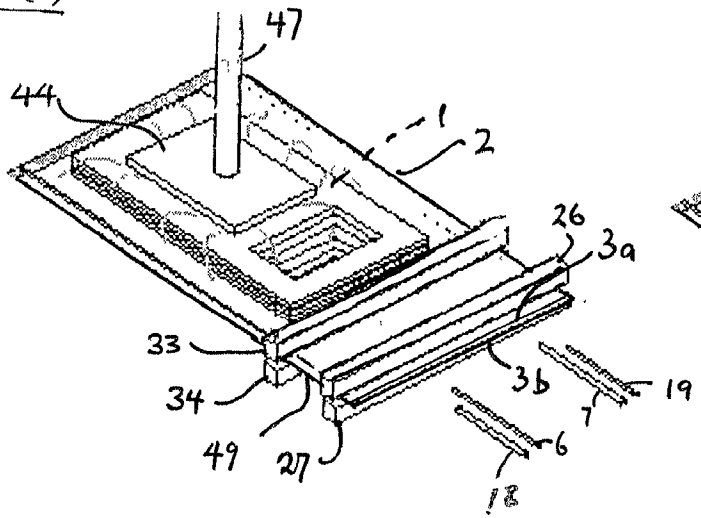
Figure 9C:
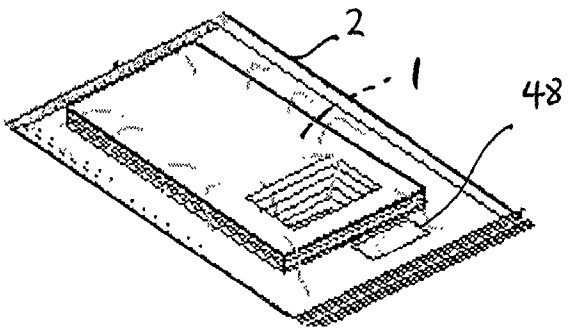

When a sufficient vacuum (76 cm Hg below atmospheric pressure) has been established within the pouch, which can typically take between about 20 seconds and about 4 minutes, depending on the size and nature of the pouch and its contents, the crossbar 11 is moved backwards to withdraw the air extraction tubes 6,7 and the fingers 18,19 clear of the clamp members 26,27, and the heat-sealing members 33,34 are then brought into contact with opposite sides of the sealable meeting portions 3*a*,3*b* of the mouth of the pouch 2, and a pulse of electrical current is passed through the heating elements 35,36,41 to impulse-seal the pouch in a double seal line and to trim away redundant pouch material beyond the seal lines (FIG. 9(*a*)). The clamp members 26,27 and the heat-sealing members 33,34 are then opened and the trimmed off web 49 of pouch material sent for recycling (FIG. 9(*b*)). The finished vacuum packed stack 1 of plastic bags, including a paper label 48, is then removed from the apparatus (FIG. 9(*c*)).

The paper label 48 and/or the pouch 2 may include markings provided to direct a person to open the vacuum pack by initially puncturing the pouch 2 in the region of the paper label 48 one or more times. If the enclosure is punctured more than one time, e.g. twice, multiple parallel tear lines can be formed, to open the pack by effectively peeling back a strip of the pouch material. In this way, by breaking the pouch near the seal and starting one or more tear line in a direction towards the stack 1, it is easy to tear the enclosure sufficiently to gain access to the packed stack 1 of bags. The ease of opening the pack in this way is enhanced if the pouch 2 is orientated such that any preferential direction of tearing of the pouch material to open the pouch extends from the seal towards the vacuum packed stack 1 in the pouch 2.

The above broadly describes the present invention, without limitation. Variations and modifications as will be readily apparent to those skilled in this art are intended to be included within the scope of this application and subsequent patent(s).

The invention claimed is:

1. An apparatus for vacuum packing a compressible product in a flexible enclosure therefor, the apparatus comprising:

means for evacuating air from within an unsealed enclosure, the product being disposed within the unsealed enclosure;

means, disposed externally of the unsealed enclosure containing the product disposed therein, for compressing the product within the enclosure prior to evacuation of the air from within the enclosure, whereby air trapped in the enclosure and the product is pushed out of the enclosure and/or the product prior to evacuation of air from the enclosure;

means for sealing sealable meeting portions of the unsealed enclosure in an airtight manner after the said evacuation of air, wherein the means for compressing the product comprises a pressure plate mounted in a plane parallel to the plane of an opposed surface upon which the unsealed enclosure is disposed in use, which pressure plate bears against a portion of the enclosure to compress the product, disposed within the enclosure, against the opposed surface; and means, independent from the means for evacuating air, for restraining sealable meeting portions of the unsealed enclosure, during evacuation of air, said means for restraining being capable of positive reciprocal lateral movement.

2. An apparatus for vacuum packing according to claim 1 wherein the pressure plate is a pneumatically actuable pressure plate.

3. An apparatus for vacuum packing according to claim 1, wherein the pressure plate bears against a portion of the enclosure in a continuous manner during the vacuum packing.

4. An apparatus for vacuum packing according to claim 1, wherein the apparatus is provided with a support surface to provide said opposed surface.

5. An apparatus for vacuum packing according to claim 4, wherein the support surface comprises a rigid planar sheet supported adjacent the operative parts of the apparatus, of dimensions larger than the assembly of the product and the unsealed enclosure.

6. An apparatus for vacuum packing a product according to claim 4, wherein the support surface and the compression means are movable towards and away from one another.

7. An apparatus for vacuum packing a product according to claim 6, wherein the support surface comprises a pneumatically actuable member.

8. An apparatus for vacuum packing a product according to claim 1, wherein the apparatus further comprises pressure plates arranged to bear against a side portion and a rear portion of the product.

9. An apparatus for vacuum packing according to claim 1, wherein further compressing means is provided to compress the product prior to being disposed within the flexible enclosure.

10. An apparatus for vacuum packing according to claim 9, wherein the further compressing means comprises first and second pressure members arranged to compress the product between them.

11. An apparatus for vacuum packing according to claim 10, wherein the first and second pressure members comprise pneumatically actuable pressure plates.

12. An apparatus for vacuum packing according to claim 9, wherein the pressure plate and opposed surface of the first mentioned compressing means have cut away portions corresponding to the further compressing means such that both may act on the enclosure and product simultaneously.

13. An apparatus for vacuum packing according to claim 1, wherein means are provided for restraining sealable meeting portions of the unsealed enclosure, during the said evacuation of air, in a configuration whereby the said sealable meeting portions can be sealed without rucking thereof.

14. An apparatus for vacuum packing according to claim 13, wherein the means for restraining the sealable meeting portions of the unsealed enclosure for the evacuation of air therefrom comprises members adapted to engage the unsealed enclosure at two or more locations of the meeting portions thereof, and to apply a tension to the meeting portions between the said two or more locations thereof so that the said portions are drawn into substantially parallel alignment with respect to each other.

15. An apparatus for vacuum packing according to claim 14, wherein the members comprise finger-like structures which may be inserted at a first mutual separation distance into the mouth of the enclosure and thereafter moved mutually apart to a second, larger, separation distance corresponding to the maximum separation distance permitted by the dimensions of the mouth of the enclosure.

16. An apparatus for vacuum packing according to claim 1, wherein the means for evacuating air from within the unsealed enclosure comprises at least one air extraction passageway having a first end adapted to be disposed between the sealable meeting portions of the flexible enclosure and connectable to a suction source for extraction of air from the interior of the flexible enclosure.

17. An apparatus for vacuum packing according to claim 16, wherein the suction source comprises a vacuum pump.

18. An apparatus for vacuum packing according to claim 16, wherein the or each extraction passageway has multiple apertures at the first end thereof.

19. An apparatus for vacuum packing according to claim 1, wherein the means for sealing the sealable meeting portions of the unsealed enclosure in an airtight manner after evacuation of the air comprises a heat sealing device.

20. An apparatus for vacuum packing according to claim 19, wherein the heat sealing device comprises an elongate heatable member which bears against an opposed second member, with the sealable meeting portions of the unsealed enclosure interposed between the two members.

21. An apparatus for vacuum packing according to claim 20, wherein the second elongate member is heatable.

22. An apparatus for vacuum packing according to claim 21, wherein all the heatable members are actuated simultaneously.

23. An apparatus for vacuum packing according to claim 19, wherein the heating is performed electrically.

24. An apparatus for vacuum packing according to claim 19, wherein the electrical heating is only provided when the heating members are in contact with the enclosure.

25. An apparatus for vacuum packing according to claim 1, wherein a heatable member is provided to serve as a hot cutter to trim away any residual web of enclosure material beyond the seal.

26. An apparatus for vacuum packing according to claim 25, wherein the heating is performed electrically.

27. An apparatus for vacuum packing according to claim 20,21 and 25 wherein all the heatable members are actuated simultaneously.

28. An apparatus for vacuum packing according to claim 25, wherein all the heatable members are actuated simultaneously.

29. An apparatus for vacuum packing according to claim 1, wherein the apparatus further comprises a clamping means adapted and located to clamp together in a substantially airtight manner meeting portions of the unsealed enclosure in a region located between the intended place of sealing of the meeting portions of the enclosure and the periphery of the enclosure.

30. An apparatus for vacuum packing according to claim 29, wherein the clamping means comprises a pair of opposed clamp members disposed on opposite sides of the meeting portions of the enclosure, the clamp members being movable towards and away from one another to facilitate clamping and release of the sealable meeting portions of the enclosure.

31. An apparatus for vacuum packing according to claim 29, wherein the apparatus further comprises a second clamping means, spaced apart from the first clamping means and adapted and located to clamp together in a substantially airtight manner meeting portions of the unsealed enclosure located between the product contained therein and the intended place of sealing of the meeting portions of the enclosure.

32. An apparatus for vacuum packing according to claim 31, wherein the second clamping means comprises a pair of opposed clamp members disposed on opposite sides of the meeting portions of the enclosure, the clamp members being movable towards and away from one another to facilitate clamping and release of the sealable meeting portions of the enclosure.

33. An apparatus for vacuum packing according to claim 29, wherein the or each of the clamping means are made of a material which is conformable in a substantially airtight manner to the shape of the apparatus parts interposed between said clamping means.

34. An apparatus for vacuum packing a compressible product in a flexible enclosure therefore, the apparatus comprising:

means for evacuating air from within the unsealed enclosure, the product being disposed within the unsealed enclosure;

means, disposed externally of the unsealed enclosure containing the product disposed therein, for compressing the product within the enclosure prior to evacuation of the air from within the enclosure, whereby air trapped in the enclosure and the product is pushed out of the enclosure and the product prior to evacuation of air from the enclosure, the means for compressing the product comprising a pressure plate mounted in a plane parallel to the plane of an opposed surface upon which the unsealed enclosure is disposed to use, which pressure plate bears against a portion of the enclosure to compress the product, disposed within the enclosure, against the opposed surface;

means for sealing sealable meeting portions of the unsealed enclosure in an airtight manner after the said evacuation of air; and means for restraining said sealable meeting portions of the unsealed enclosure, during evacuation of air, said means for restraining being capable of positive reciprocal lateral movement;

clamping means adapted and located to clamp together in substantially airtight manner meeting portions of the unsealed enclosure in a region thereof located between the intended place of sealing of the meeting portions of the enclosure and the periphery of the enclosure.

35. An apparatus for vacuum packing a compressible product in a flexible enclosure therefore, the apparatus comprising:

means for evacuating air from within the unsealed enclosure, the product being disposed within the unsealed enclosure;

means, disposed externally of the unsealed enclosure containing the product disposed therein, for compressing the product within the enclosure prior to evacuation of the air from within the enclosure, whereby air trapped in the enclosure and the product is pushed out of the enclosure and the product prior to evacuation of air from the enclosure, the means for compressing the product comprises a pressure plate mounted in a plane parallel to the plane of an opposed surface upon which the unsealed enclosure is disposed in use, which pressure plate bears against a portion of the enclosure to compress the product, disposed within the enclosure, against the opposed surface; and means for sealing sealable meeting portions of the unsealed enclosure in an airtight manner after the said evacuation of air, means for restraining said sealable meeting portions of the unsealed enclosure, during evacuation of air, said means for restraining being capable of positive reciprocal lateral movement;

wherein the opposed surface is in the form of a support surface which is moveable with respect to the compression means.

* * * * *